US009188327B2

(12) United States Patent
Billy

(10) Patent No.: US 9,188,327 B2
(45) Date of Patent: Nov. 17, 2015

(54) FIRE SAFETY CLOSURE SYSTEM FOR CANDLE HOLDERS

(71) Applicant: Dennis Richard Billy, Kelowna (CA)

(72) Inventor: Dennis Richard Billy, Kelowna (CA)

( * ) Notice: Subject to any disclaimer, the term of this patent is extended or adjusted under 35 U.S.C. 154(b) by 0 days.

(21) Appl. No.: 14/561,103

(22) Filed: Dec. 4, 2014

(65) Prior Publication Data

US 2015/0104749 A1 Apr. 16, 2015

Related U.S. Application Data

(63) Continuation-in-part of application No. 13/286,212, filed on Oct. 31, 2011, now Pat. No. 8,920,157.

(60) Provisional application No. 61/413,563, filed on Nov. 15, 2010.

(51) Int. Cl.

| | |
|---|---|
| ***F23L 7/00*** | (2006.01) |
| ***F21V 35/00*** | (2006.01) |
| ***F23Q 25/00*** | (2006.01) |

(52) U.S. Cl.

CPC ..... *F21V 35/00* (2013.01); *F23Q 25/00* (2013.01); *Y10T 29/49826* (2015.01)

(58) Field of Classification Search

CPC ..... F21L 17/00; F21L 19/00; F21L 21/00; F21L 23/00; F21L 26/00; F21L 25/00; F23Q 25/00; F23D 3/26

USPC ..... 431/2, 155, 34; 215/200–364; 220/254.9, 254.5, 254.3, 254.2, 254.4, 220/254.1, 212, 259.5, 259.2, 259.1, 256.1

See application file for complete search history.

*Primary Examiner* — Kenneth Rinehart
*Assistant Examiner* — Jason Lau
(74) *Attorney, Agent, or Firm* — Tran & Associates

(57) ABSTRACT

A fire safety system to prevent fire from a candle includes first and second closure halves, each having catches extending therefrom; a catch receiver holder for engaging the catches; a candle holder adapted to receive the candle; a pivot pin running through pivot holes in the closure halves; and a sleeve housing the closure halves.

13 Claims, 22 Drawing Sheets

FIRE SAFETY CLOSURE SYSTEM FOR CANDLE HOLDERS

CROSS-REFERENCE TO RELATED APPLICATIONS

This application is a Continuation-In-Part of co-pending U.S. patent application Ser. No. 13/286,212, filed on Oct. 31, 2011 which claims priority from U.S. Provisional Patent Application No. 61/413,563 filed Nov. 15, 2010. Each of the aforementioned applications is incorporated herein by reference.

FIELD OF INVENTION

This invention relates to a novel device in the general field of flame holder devices, and more specifically to a fire safety closure system for candle holders which snap shut when overturned or impacted.

BACKGROUND OF THE INVENTION

Lit candles are usually associated with a soft, warm, or romantic setting. Candle light dinners are viewed as romantic, and why candles can add so much warmth. Candles can also be a source of danger. Candles are responsible for a growing percentage of home fires. In 2001, candles were responsible for 6% of the fatalities that occurred as a result of home fires. (ref. NFPA's Fire Prevention Week website)

Human error is typically responsible for starting candle fires. Some of the frequent mistakes people make include:

- leaving candles burning with no one in the room
- burning candles close to materials that can catch fire (e.g., curtains, party decorations, clothing)
- leaving burning candles within the reach of children or pets
- falling asleep or leaving the house with candles burning In some cases, fires are started because the candle wax gets so hot it catches fire itself. Canada-wide statistics for candle fires are not available. However, in Alberta between 1990 and 1999, the number of candle fires increased by 100%, reaching a total of 723 fires with 10 fire deaths, 168 fire injuries and $12.4 million in property damages. Because people are using candles more frequently, these figures are on the rise, especially during holidays and special occasions. (ref. Health Canada website—Candle Safety)

Another safety consideration is the fact that rural areas often rely on candles as a backup source of light during power outages. During these sometimes prolonged events, general visibility and depth perception is lowered, and therefore the risk of inadvertently overturning or striking a candle or candles is increased. While placing candles inside jars or other containers (or filling containers with candlewax) can somewhat improve the stability of the flame holder, these containers also pose the risk that when overturned their flame is not as easy to notice as a bare candle, due to being surrounded by a container. By this means, a jar candle may spill hot wax onto other flammable materials before one may notice, creating a pathway for the candle flame to ignite the flammable materials, causing damage and danger.

Some known solutions include candles with insert able wick cutters which are inserted directly into the sides of freestanding candles, but these require the user to remember to manually insert the cutter at the appropriate location. By this means, the candle puts itself out when the severed wick is reached. (U.S. Pat. No. 6,447,286) This method does not address the issue of overturning the candle before it self-extinguishes.

In a related category, automatically (timed) lid closers include a lid attached to the rim of a candle container which flips onto the top of the container when activated by a timer mechanism. (U.S. Pat. No. 6,494,708) Again, this method only addresses automatic closure of the candle holder, but not closure in direct response to an unsafe orientation or impact.

Some candles in containers include a layer of fire suppressant material embedded under the candlewax so that when that layer is reached by the flame, the candle self-extinguishes. (US20090233249) Finally, a mechanical overturn safety device is commonly employed inside portable kerosene stoves which responds to impact or overbalance by shutting off the gas, flame, or both. (U.S. Pat. No. 5,640,948)

The existing solutions demonstrate a need for an automatic closure system for containerized candles that closes when the container is overturned or impacted sharply, and which thereby snuffs out any flame and prevents any fire or wax from spreading onto flammable materials outside the container.

BRIEF SUMMARY OF THE INVENTION

The device provides a fire safety closure system for candle holders which snaps shut when overturned or impacted. Note: for sake of brevity, hereafter the "fire safety closure system for candle holders" may also be abbreviated as the "closure system" in this document.

In a first aspect, a fire safety system to prevent fire from a candle includes first and second closure halves; a loop extending from the first closure half; a catch extending from the second closure half; a trigger pin having a first end coupled to the loop and a second end fitted to the catch; a candle holder adapted to receive the candle; and a sleeve housing the closure halves, the sleeve including a plurality of impact legs.

In a second aspect, a fire safety system to prevent fire from a candle includes first and second closure halves; a candle holder inside the first and second closure halves and adapted to receive the candle; a sleeve housing the closure halves, and a trip device to close the first and second closure halves when the candle holder is tipped or the candle holder is struck with a predetermined force.

In a third aspect, a method to prevent candle fire includes biasing the first and second closure halves with a spring; securing a trigger pin to the first and second closure halves; dropping the trigger pin when the candle holder is tipped onto a side or the candle holder is struck with a predetermined force; and closing the first and second closures.

In a fourth aspect, a containment system for a liquid container includes first and second closure halves; a loop extending from the first closure half; a catch extending from the second closure half; a trigger pin having a first end coupled to the loop and a second end coupled to the catch; a container holder adapted to receive the liquid container; and a sleeve housing the closure halves, the sleeve including a plurality of impact legs, wherein the closure halves are sealed shut when the container holder is tipped onto a side or the container holder is struck with a predetermined force.

In a fifth aspect, a fire safety system to prevent fire from a candle includes a first closure half with a first catch extending therefrom; a second closure half with a second catch extending therefrom; a catch receiver holder for engaging each of the first and second catches; a candle fire trap adapted to receive the candle; a pivot pin running through pivot holes in the closure halves; and a sleeve housing attached to the closure halves.

In a sixth aspect, a method to prevent candle fire includes biasing the first and second closure halves with a spring; securing a first catch and a second catch to edges of the first and second closure halves wherein each of the first and second catches are engaged in a catch receiver holder; disengaging the first and second catches from the catch receiver holder when the candle holder is tipped onto a side or the candle holder is struck with a predetermined force; running a pivot pin through pivot holes in the closure halves; and closing the first and second closures.

In a seventh aspect, a containment system for a liquid container includes a first closure half with a first catch extending therefrom; a second closure half with a second catch extending therefrom; a catch receiver holder for engaging each of the first and second catches; a container holder adapted to receive the liquid container; a pivot pin running through pivot holes in the closure halves; and a sleeve housing the closure halves, wherein the closure halves are sealed shut when the container holder is tipped onto a side or the container holder is struck with a predetermined force.

Advantages of the present closure system may include its ability to operate without user attention with a mechanism that prevents the user from burning a candle until the safety system is activated. The primary advantage of the disclosed closure system is the prevention of inadvertent fires caused by tipping over a candle holder in one's home, garage, boat, cabin, mobile home or tent. The closure system allows a user to safely use candles, glass of beverage, toy trap, in containers, jar candles, plastic beverage containers, children toy trap by employing a means to snuff out the candle flame, stop beverage from spilling, or trapping a play wrestling doll if the container is overturned or struck sharply. In normal use the closure system is held open so that the candle has oxygen, and produces light through the transparent or translucent container. When struck or tilted onto the ground, the impact causes the two halves of the top lid to snap closed, and thereby snuffs out the candle flame, stopping your beverage from spilling or trapping the wrestling doll.

DETAILED DESCRIPTION

Figure 1:
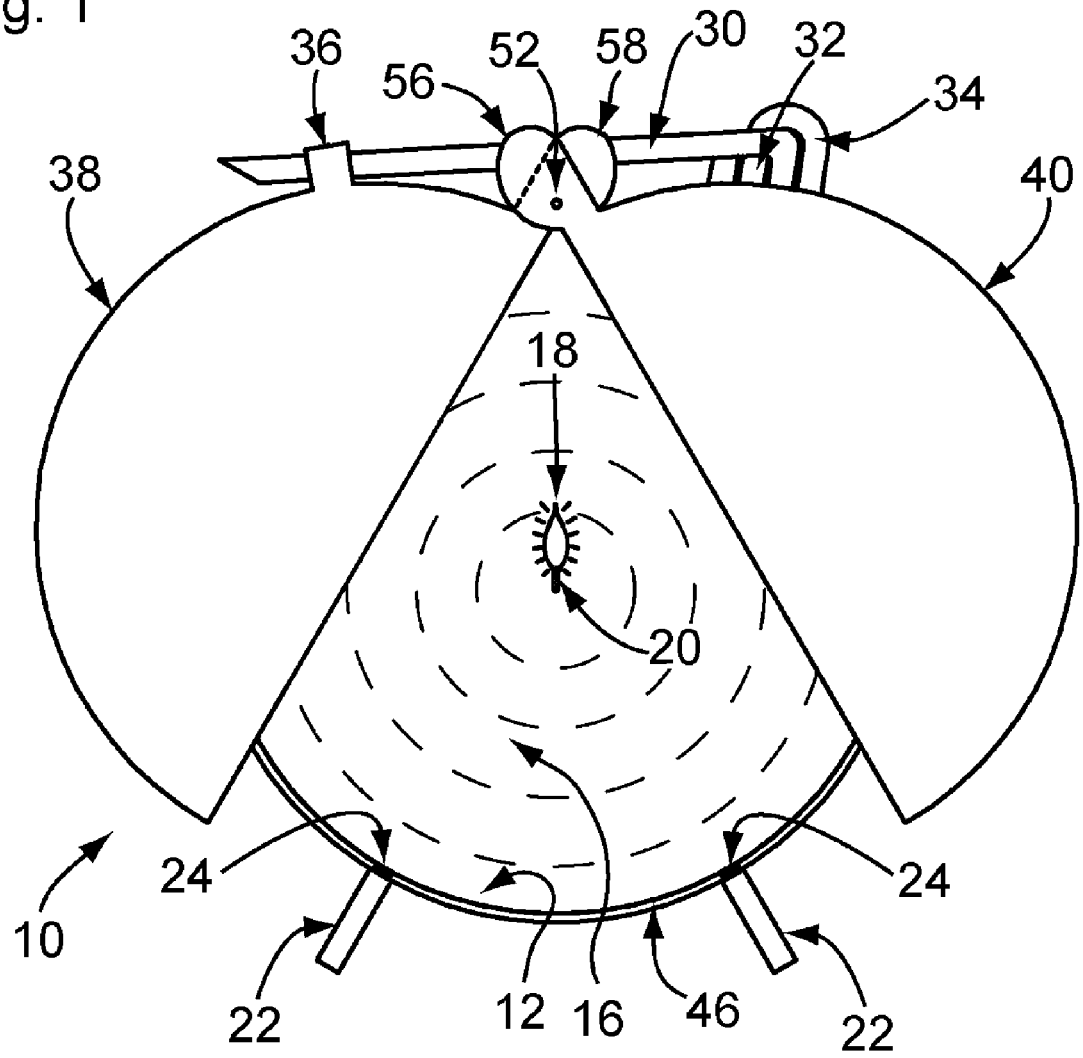
FIG. 1 shows a top view of a cylindrical holder version of the invention with its trigger pin holding open its closure halves.

FIG. 1 shows a top view of a cylindrical holder 12 version of the closure system 10 with its trigger pin 30 holding open its closure halves (38 & 40). The eye 32 of the trigger pin 30 is attached to the loop 34 which extends from the right cylindrical closure 40. The other end of the trigger pin 30 fits under the catch 36 which extends from the left cylindrical closure 38 as shown. The left cylindrical closure 38 includes a protruding left tang 58, while the right cylindrical closure 40 has a similar right tang 56, and both are hinged together by means of a pivot (pin) 52. The candle 16 with its flame 18 and wick 20, are housed in the cylindrical holder 12, on which is secured a cylindrical sleeve 46 onto which the above closure elements are housed. The cylindrical sleeve 46 has a multiplicity of impact legs 22 threaded into holes and closure bracket or made one with sleeve as in all stamp from one piece of sheet steel 28 and 24 around its periphery in one embodiment. In this embodiment, a 1 mm sheet steel is used, but other thicknesses can be used as well. In place of steel, other suitable hardened materials can be used.

Figure 2:
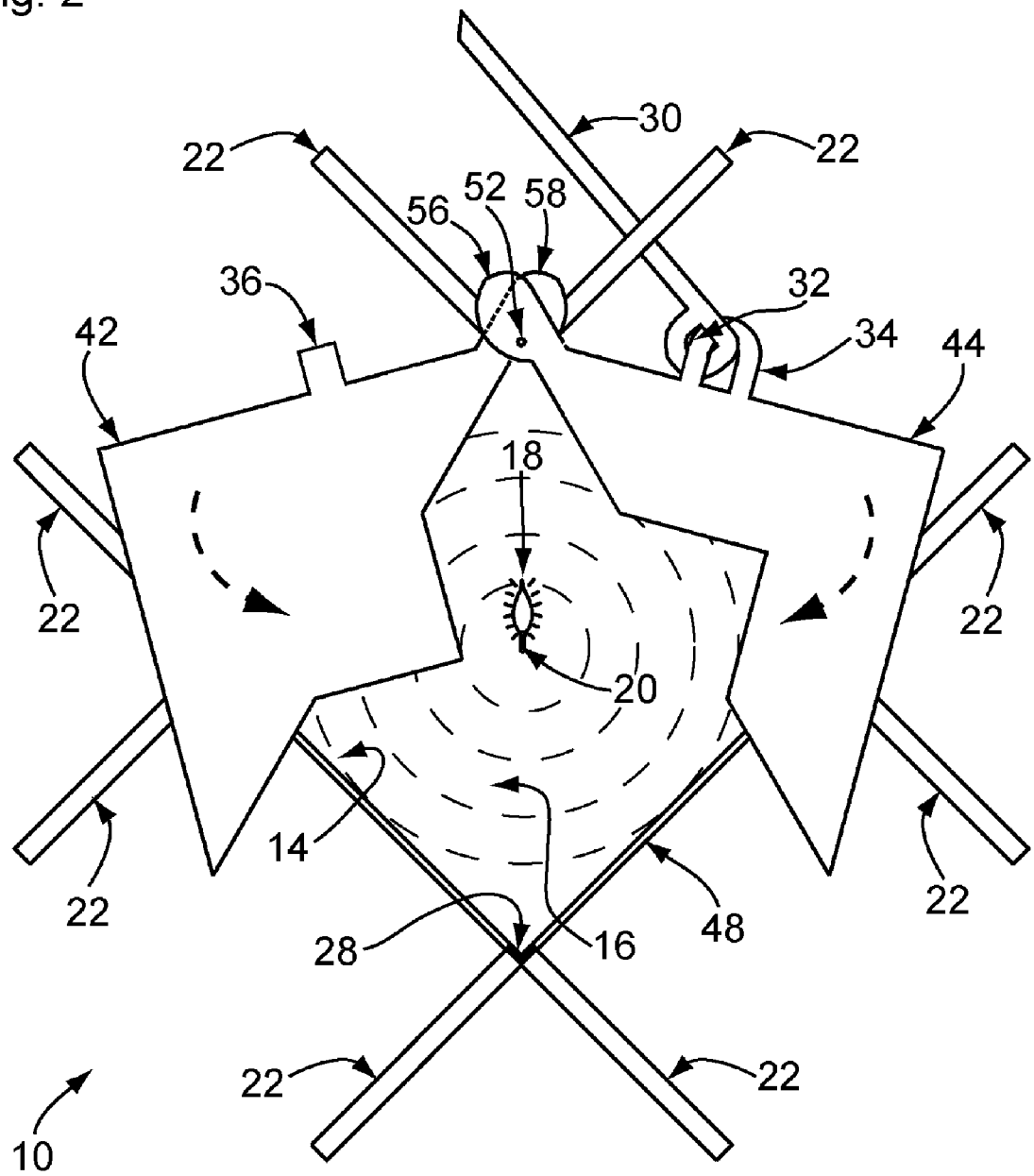
FIG. 2 shows a top view of a rectangular holder version of the invention with its trigger pin holding open its closure halves.

FIG. 2 shows a top view of a rectangular holder 14 version of the closure system 10 with its trigger pin 30 released from its catch 36 and its closure halves (42 & 44) in the process of snapping shut (broken arrows). The rectangular sleeve 48 shows its impact legs 22 secured to its corners by means of a weld or made one with sleeve as in all stamp from one piece of sheet steel 28. All other elements are similar to the cylindrical version.

Figure 3A:
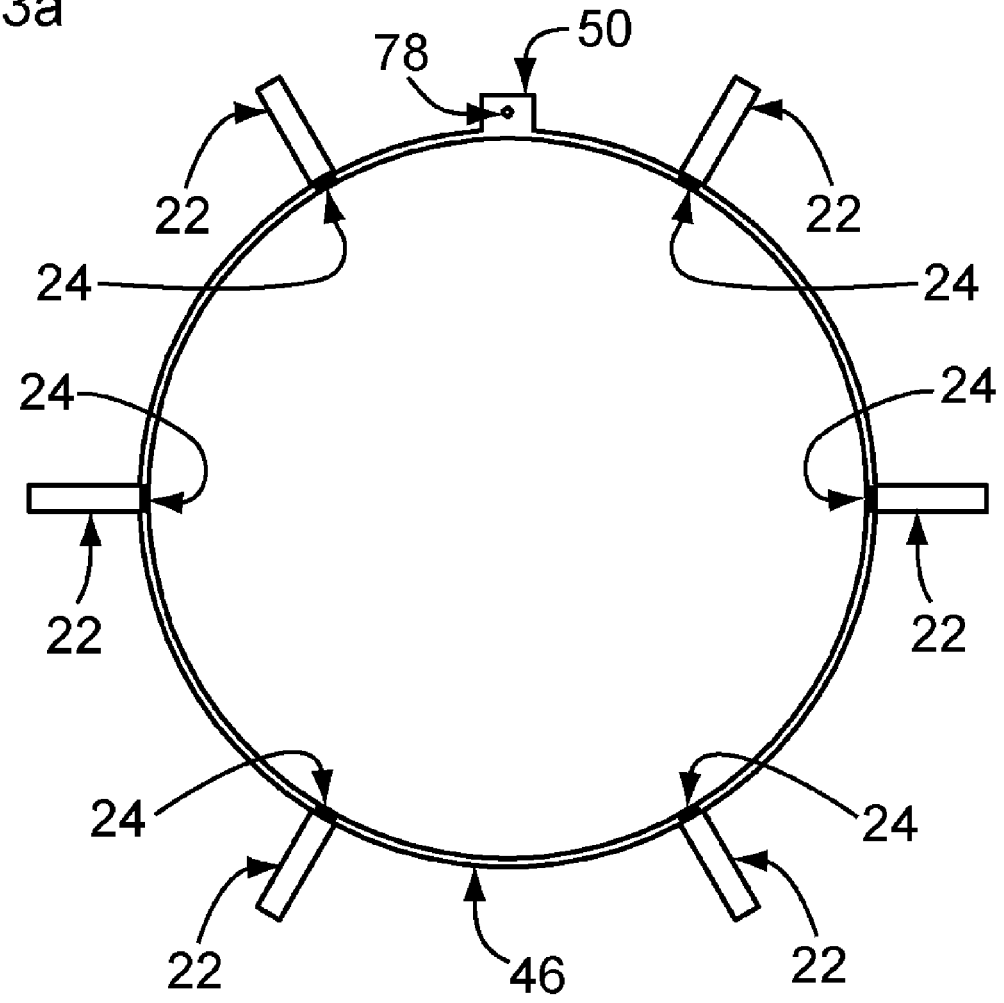
FIG. 3A shows a top view of a cylindrical holder sleeve assembly.
Figure 3B:
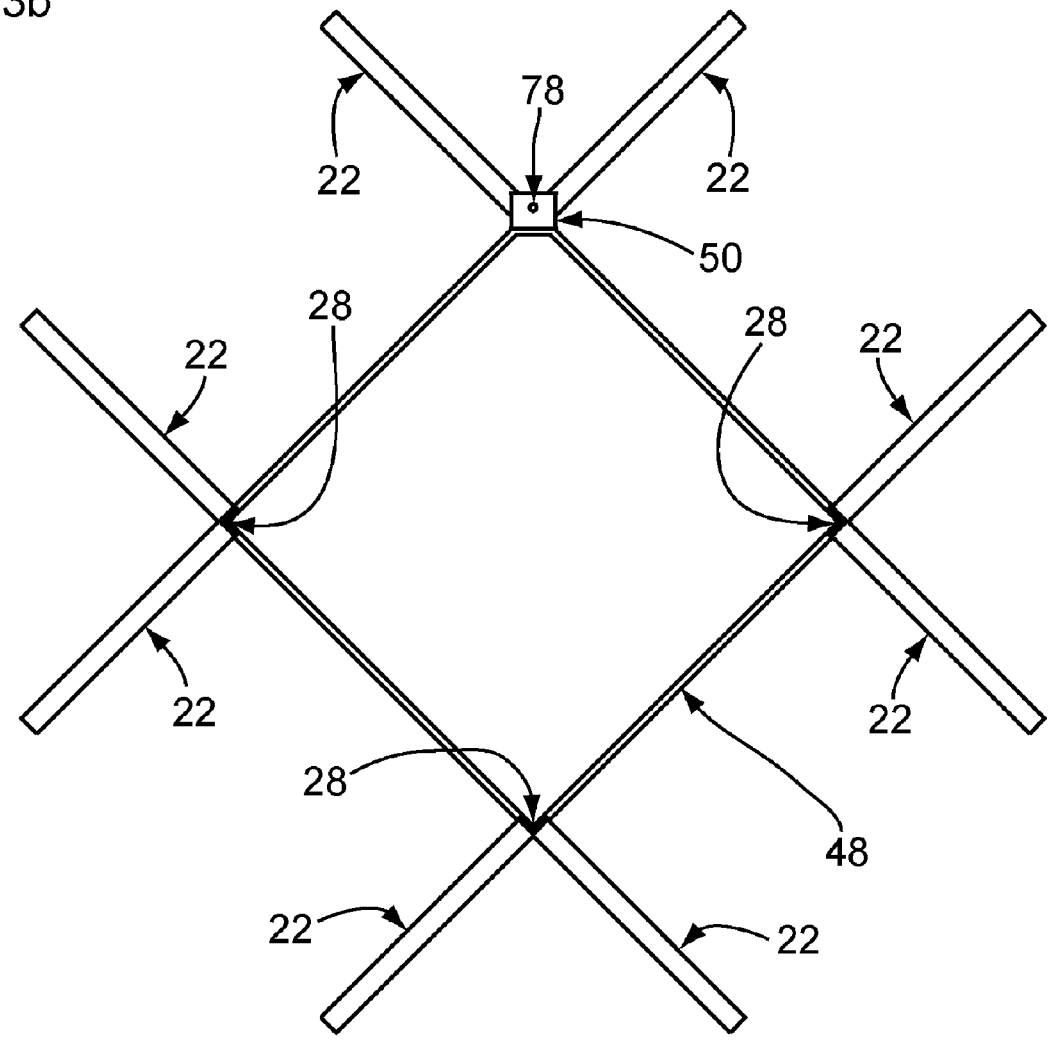
FIG. 3B shows a top view of a rectangular holder sleeve assembly.

FIG. 3A shows a top view of a cylindrical sleeve 46 assembly which includes impact legs 22 secured through threaded holes 24, and also exposes the top of the closure bracket 50 with its pivot hole 78 through which the pivot 52 rotates. (see FIG. 6*a*) FIG. 3*b* shows a top view of a rectangular sleeve 48 assembly which includes impact legs 22 secured by means of welds 28, and the closure bracket 50 with its pivot hole 78.

Figure 4A:
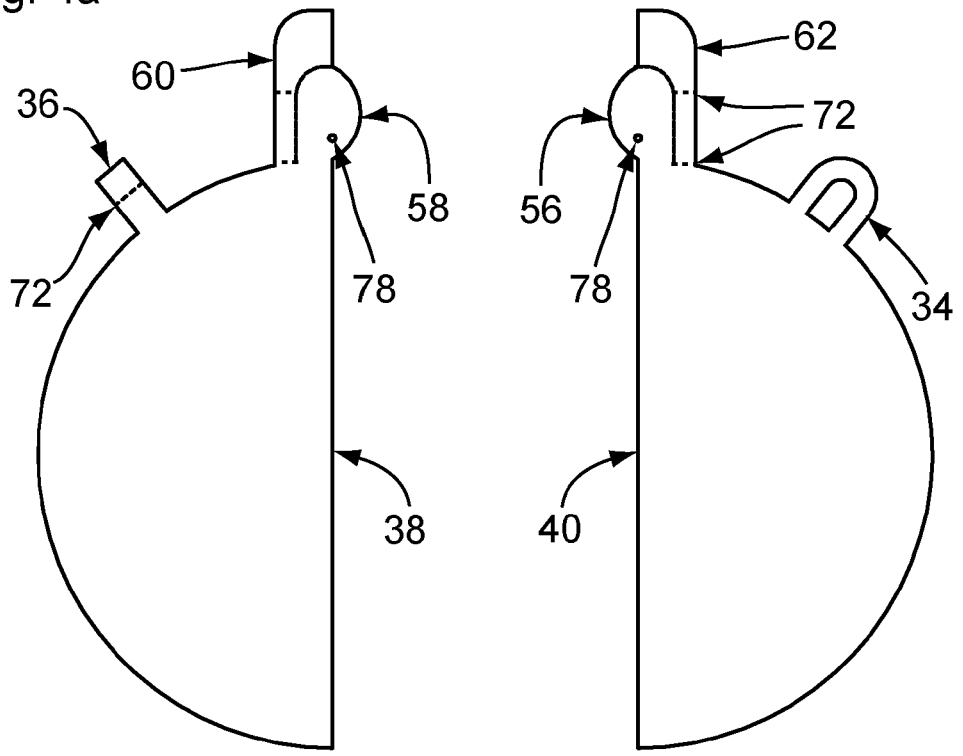
FIG. 4A shows a plan view of the closure halves for a cylindrical holder.
Figure 4B:
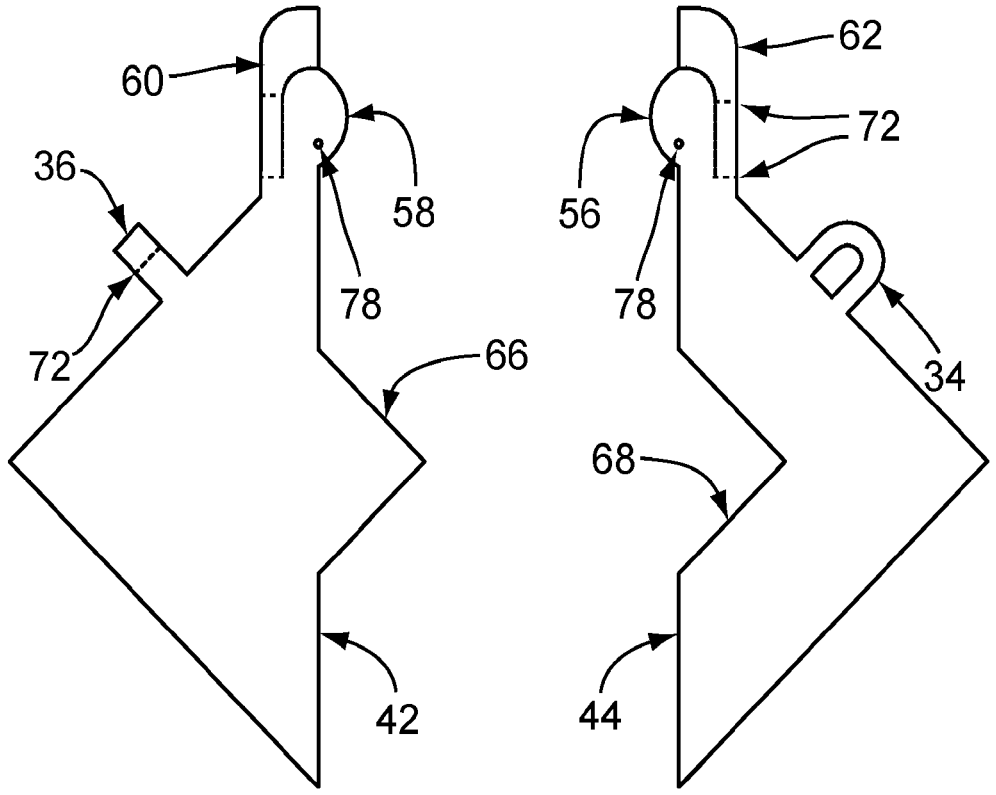
FIG. 4B shows a plan view of the closure halves for a rectangular holder.

FIG. 4A shows a plan view of the closure halves (38 & 40) for a cylindrical holder 12, exposing the left & right rudder (60 & 62) elements which are folded at fold lines 72 shown. FIG. 4B shows a plan view of the closure halves (42 & 44) for a rectangular holder 14, similarly exposing the left & right rudder (60 & 62) elements which are folded at fold lines 72 shown. The left rectangular closure 42 engages the right rectangular closure 44 by means of its guide 66 inserting into a notch 68 as shown.

Figure 4C:
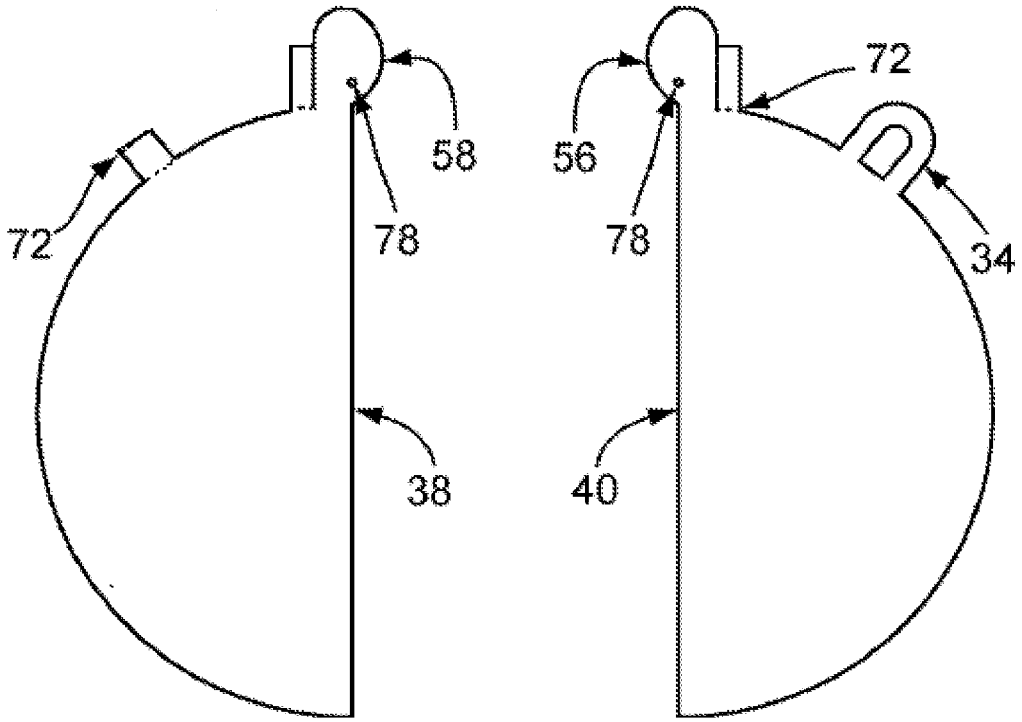
FIG. 4C shows a plan view of the closure halves for a second cylindrical holder embodiment.
Figure 4D:
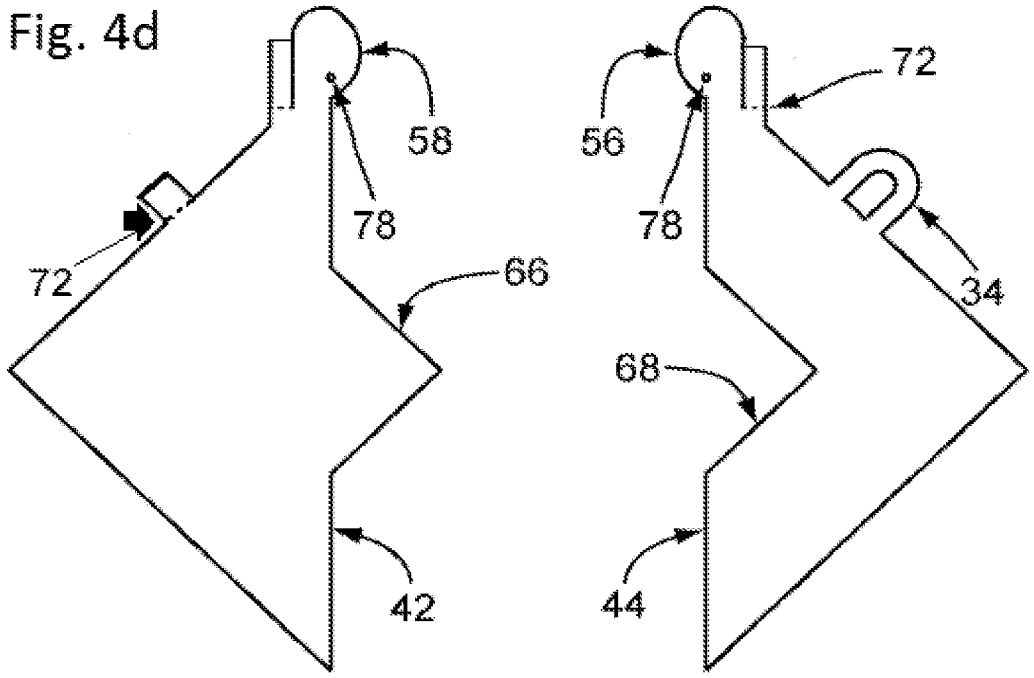
FIG. 4D shows a plan view of the closure halves for a second rectangular holder embodiment.

FIG. 4C shows a plan view of the closure halves for a second cylindrical holder embodiment while FIG. 4D shows a plan view of the closure halves for a second rectangular holder embodiment. The embodiments of FIGS. 4C-4D are similar to the embodiments of FIGS. 4A-4B, without the rudders 60 and 62.

Figure 5A:
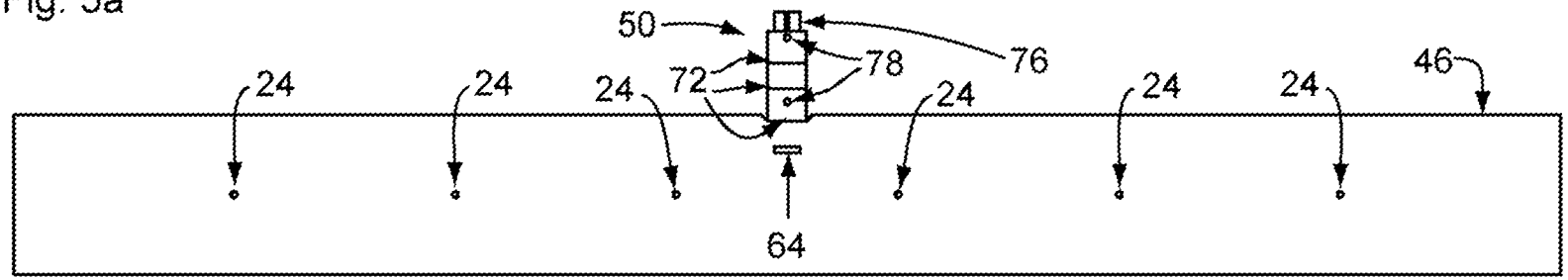
FIG. 5A shows a plan view of an unassembled cylindrical holder sleeve.
Figure 5B:
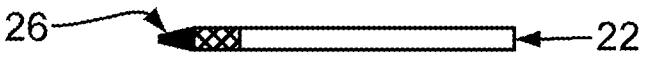
FIG. 5B shows a side view of a threading impact leg.
Figure 5C:
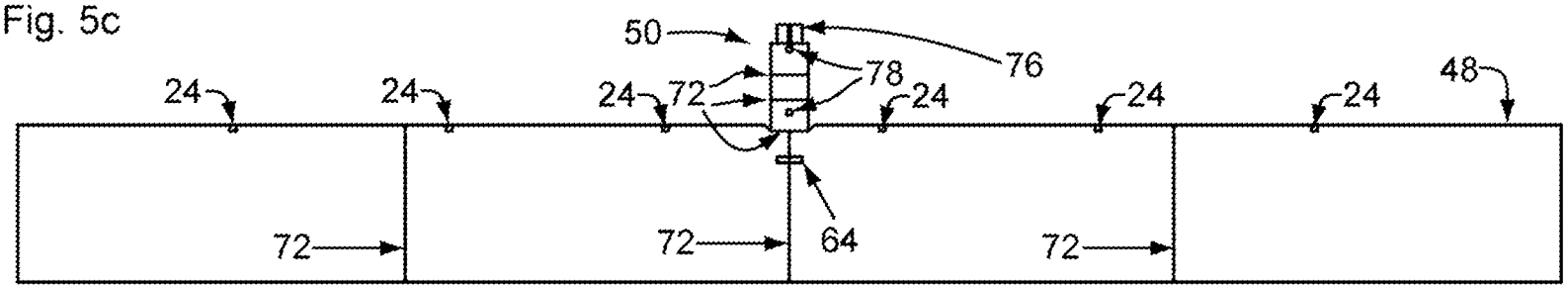
FIG. 5C shows a plan view of an unassembled rectangular holder sleeve.

FIG. 5A shows a plan view of an unassembled cylindrical sleeve 46 with its threaded holes 24 and a slot 64 in which is inserted the tab 76 when the closure bracket 50 is folded at lines 72. When this is done, the pivot holes 78 are aligned and the pivot 52 (not shown) can then rotate within the frame formed by the closure bracket 50 which is now part of the wall of the cylindrical sleeve 46. FIG. 5*b* shows a side view of an impact leg 22 which is secured to a cylindrical sleeve 46 (see FIG. 3*a*) by means of threading 26. FIG. 5C shows a plan view of an unassembled rectangular sleeve 48 with its threaded holes 24 and a slot 64 in which is inserted the tab 76 when the closure bracket 50 is folded at lines 72. An alternate means of attaching impact legs 22 to a rectangular sleeve 48 is by welds 28 at the corners of the sleeve 48 as shown in FIG. 3*b*. The corners of a rectangular sleeve 48 are defined by the fold lines 72 shown herein.

Figure 6A:
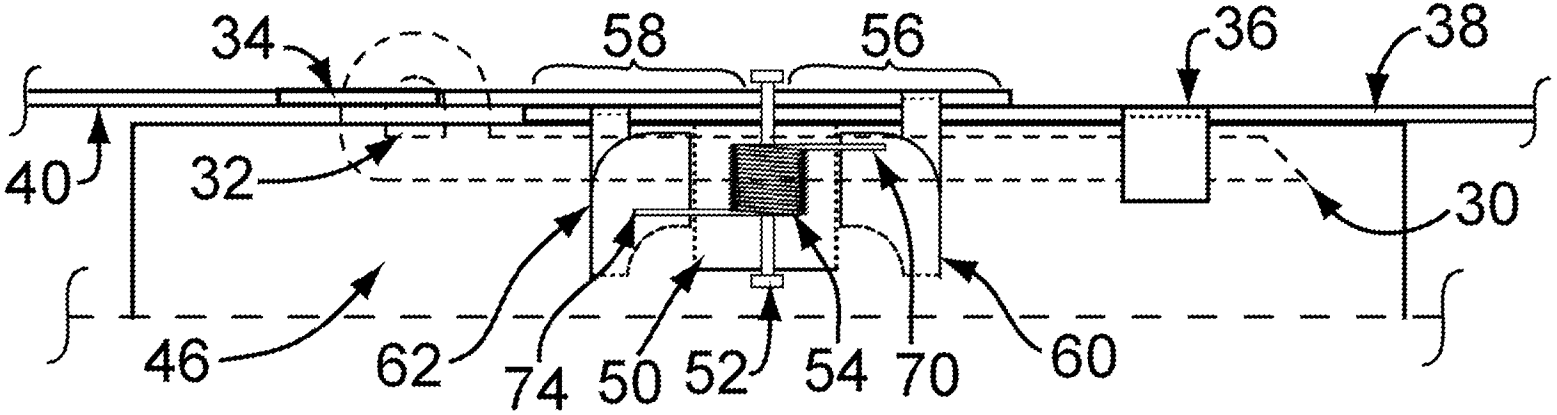
FIG. 6A shows a rear close up view of a closure and bracket assembly.
Figure 6B:
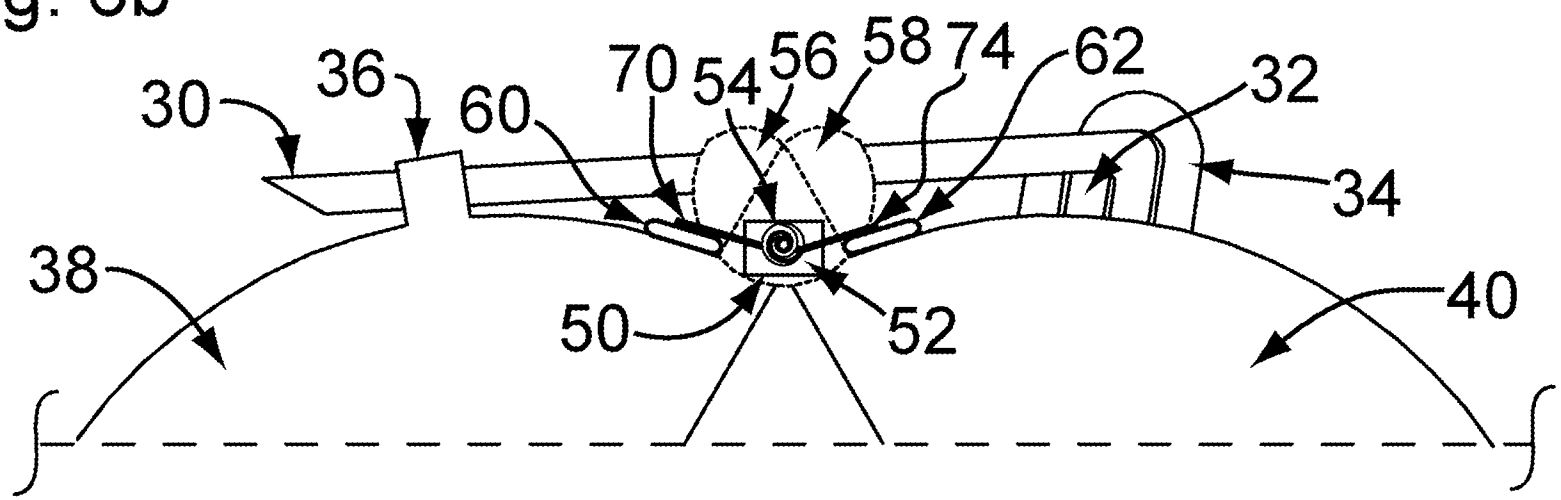
FIG. 6B shows a top close up view of a closure and bracket assembly.

FIG. 6A shows a close-up view of the rear of a cylindrical sleeve 46, cylindrical closures (38 & 40), and closure bracket 50 assembly. From this orientation, one can see how the catch 36 is folded, as well as how the left and right rudders (60 & 62) are formed. Central to the device, the pivot 52 runs through a spring 54 which employs its left spring arm 70 over the left rudder 60, and its right spring arm 74 over the right rudder 62. The spring 54 and pivot 52 are secured to the cylindrical sleeve 46 by means of the closure bracket 50 as shown. FIG. 6B shows a close-up view of the top of a cylindrical sleeve 46, cylindrical closures (38 & 40), and closure bracket 50 assembly. From this orientation, one can see most of the same elements of FIG. 6A with an eye to how the mechanism operates in practice, and which will be described in detail below.

Figure 7A:
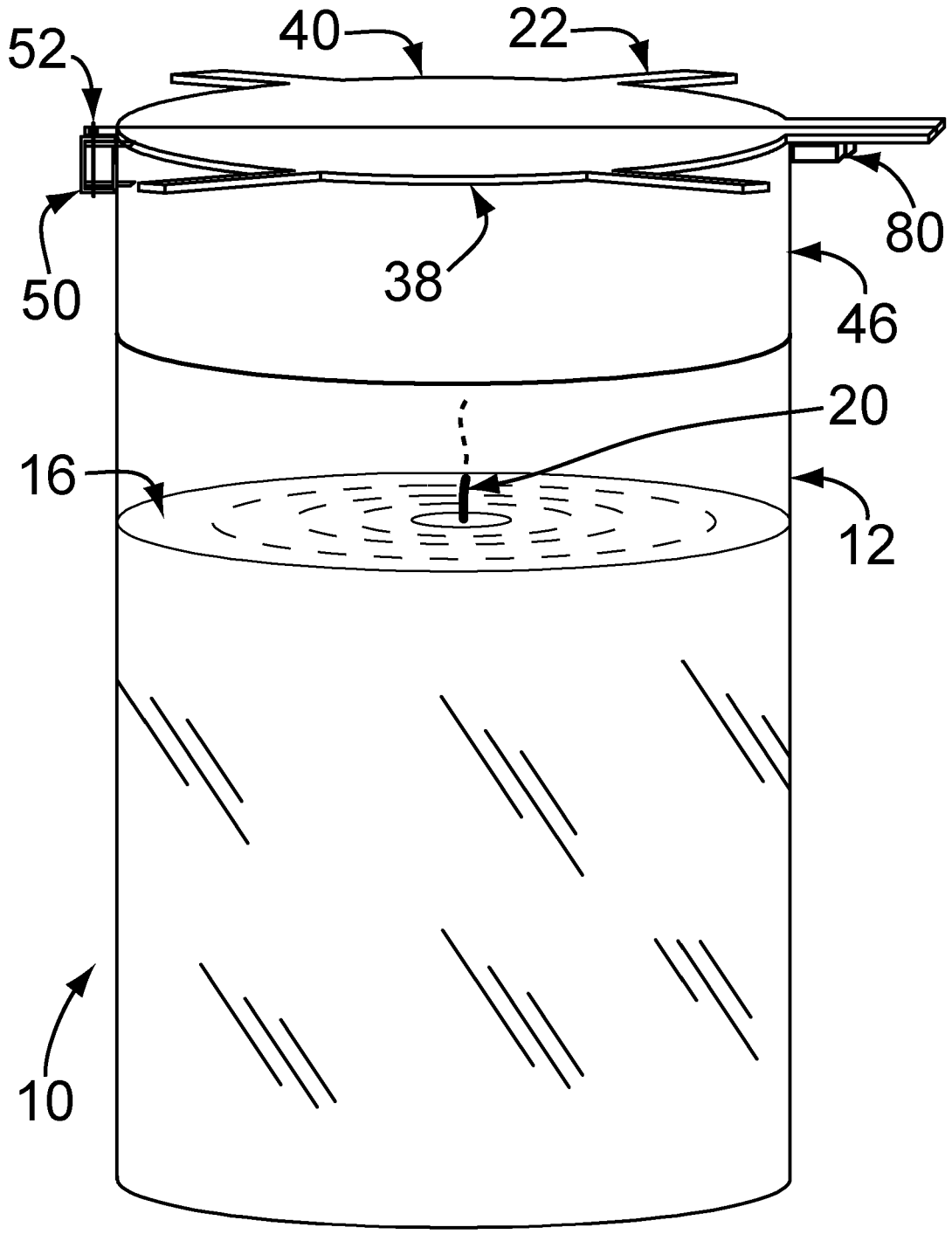
FIG. 7A shows an isometric view of the invention fitted onto a cylindrical candle holder with its closure triggered and the candle extinguished. This figure also shows elements of an alternate embodiment.
Figure 7B:
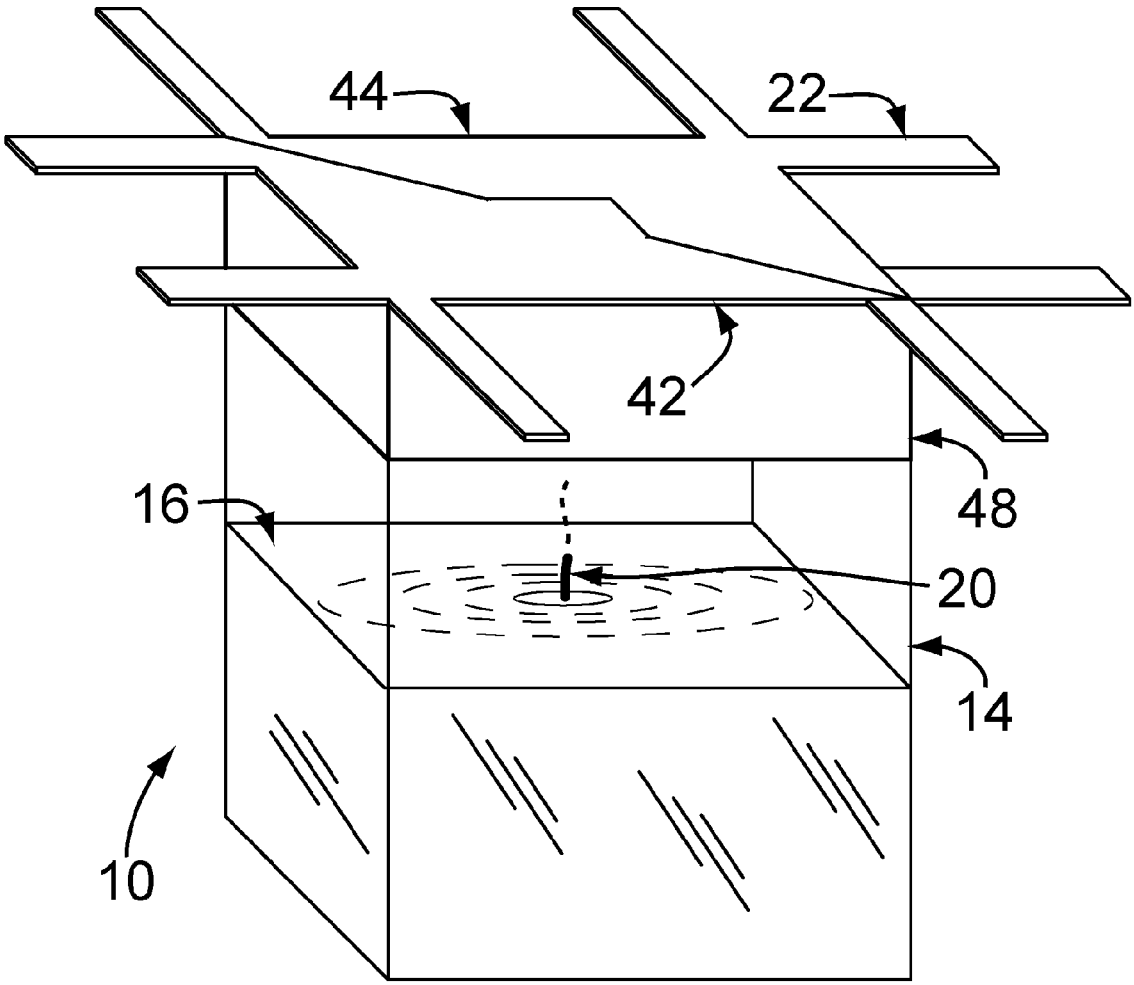
FIG. 7B shows an isometric view of the invention fitted onto a rectangular candle holder with its closure triggered and the candle extinguished.

FIG. 7A shows an isometric view of the closure system 10 fitted onto a cylindrical holder 12 with its closure mechanism triggered and the candle extinguished. Note that the impact legs of the left and right cylindrical closures (38 & 40) are formed as part of the closure halves, and his represents an alternate embodiment of the basic invention. The cylindrical sleeve 46 is securely fitted onto a cylindrical holder 12 which holds a candle 16 with its wick 20, which is shown after recently being extinguished by means of the closure activation. FIG. 7*a* also teaches an alternate embodiment which is described in more detail below. FIG. 7B shows an isometric view of the closure system 10 fitted onto a rectangular holder 14 with its closure mechanism triggered and the candle extinguished. Similar to FIG. 7A, impact legs 22 are formed as part of the left & right rectangular closures (42 & 44). Also, none of the triggering or closure mechanism is shown in this view. The rectangular sleeve 48 is fitted onto a rectangular holder 14 which holds a candle 16 with its wick 20, which is shown after recently being extinguished by means of the closure activation.

The preferred embodiment of the Fire Safety Closure System for Candle Holders will now be described in detail including how each assembly interacts with each other assembly to achieve the outcomes outlined above. The complete closure system 10 will be nominally divided into three assemblies, namely the trigger, the sleeve, and the closure mechanism.

The trigger assembly is nominally comprised of the trigger pin 30, its eye 32, and the points at which it secures the closures open, namely the loop 34 and the catch 36. Also included in the trigger mechanism are the impact legs 22 irrespective of whether they are attached to the sleeve or the closures.

The sleeve assembly is nominally comprised of either a cylindrical or rectangular sleeve (46 or 48) and is attached to respectively, a cylindrical or rectangular candle holder (12 or 14). The sleeve assembly also forms part of and supports a critical element of the closure system 10, namely the closure mechanism.

One part of the closure mechanism is comprised of each closure half (38-44) which rotates around a pivot 52 which runs through the pivot holes 78 in the closure bracket 50 (see FIGS. 1 & 2). At this stage, the closure halves (38-44) are merely able to rotate freely around the pivot 52, but still require an automatic closure means when the container is either struck or overbalanced.

Figure 6C:
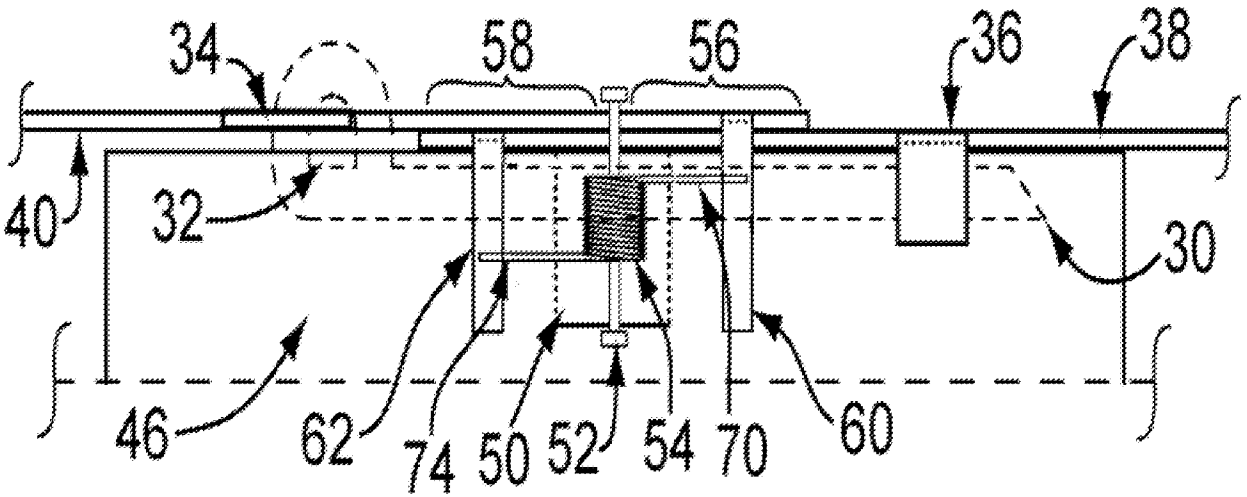
FIG. 6C shows a rear close up view of a closure and bracket assembly for a rudderless embodiment.

Referring to FIGS. 6A & 6B, this other part of the mechanism is revealed in detail. The pivot (pin) 52 shown in FIG. 6*a* is non-removably secured to the closure bracket 50 by means of welding, peening, bolting, or other such means. The spring 54 is oriented to cause each spring arm (70 & 74) to exert a force towards the surface of each respective rudder (60 & 62), wherein each rudder is attached to its respective closure half (38 & 40 or 42 & 44), and the result is that when the trigger pin 30 is released, the tension in the spring 54 causes the closure halves to snap shut. Finally, in order for the trigger pin 30 to release from its tensioned positioning in the catch 36, either the candle holder is tipped onto its side whereby an impact leg 22 is struck by the floor or other impacting surface, or the candle holder is struck with enough force to achieve the same result, whereby the pin 30 is caused to fall from the catch 36 and closure is achieved. FIG. 6C shows a rear close up view of a closure and bracket assembly for a rudderless embodiment.

Operation of an installed closure system simply requires the user to squeeze both tangs (56 & 58) together, thereby causing the closure halves (38 & 40 or 42 & 44) to open, and then insert the end of the trigger pin 30 into the catch 36. By then releasing the tangs (56 & 58), the tension of the spring 54 pressing on the closure halves (38 & 40 or 42 & 44) causes the pin 30 to be held securely. The candle 16 may now be safely lit in its holder (12 or 14), and if the holder is inadvertently tipped over, whether by human, animal or other means, the closures will automatically shut and a potential fire is prevented.

Installation of said closure system 10 is effected by means of sliding the sleeve (46 or 48) portion onto the top of the holder (12 or 14). The sleeve (46 or 48) may be secured by a close tolerance fit, threading, heat tolerant adhesives, or by means of adjustably fastening overlapping ends of the sleeve (46 or 48). This is effected by providing a number of holes for fasteners near each end of the sleeve, and at least half of these holes permit the fastening be adjusted so that the sleeve may be secured adequately so as to prevent the closure system 10 from detaching when impacted or tipped.

Other embodiments of the closure system 10 will now be described. Additional embodiments are not ruled out or similar methods leading to the same result. The two preferred embodiments include the similar closure mechanism for both cylindrical and rectangular candle holders. An alternate means of closure employs the use of high power magnets, such as small rare earth magnets, to connect the two closure halves when the candle holder is impacted with sufficient force. (see element 80 in FIG. 7*a*) These magnets 80 should be positioned in such proximity that closure is effected with a minimum threshold of impacting force. In this embodiment, a spring 54 would not be needed to close the halves, and is missing from the closure bracket 50 in FIG. 7A.

An additional embodiment may include the integration of impact legs 22 into the manufacture of each closure half as shown in FIGS. 7A & 7B. While it may be easier to manufacture and assemble the individual parts for the preferred embodiment and then combining them as described above, it has yet to be determined whether stamping out or laser cutting these integrated elements (as shown in FIGS. 7A & 7B) is more cost effective.

A minor variation of the catch 36 design concerns the location of its fold line 72, which may vary depending on the chosen tension of the spring 54, the size of the closure bracket 50, the length of the trigger pin 30, and the strength of materials employed. FIGS. 1 & 2 show a catch 36 design where the fold is extended beyond the edge of the left cylindrical closure 38 (also see FIGS. 4A & 4B). However, an alternate and possibly stronger version is shown in FIG. 6*a*, wherein the fold line 72 is at the proximate edge of the left cylindrical closure 38.

The preferred materials for constructing said closure system 10 will now be described. Other materials are not ruled out or similar combinations of materials leading to the same result. The closure halves, sleeves, and (in some embodiments) impact legs are made from 22 gauge sheet steel. Impact legs 22 in the preferred embodiment are made from steel rod, threaded to fit the threaded holes, closure bracket and legs made one with sleeve as in all stamp from one piece of sheet steel 24. The pivot 52 is also made from metal rod of sufficient strength to support the tension of the spring 54. The spring 54 is made of spring steel capable of creating sufficient force to consistently shut the closure halves. The trigger pin 30 is made of steel rod of sufficient strength to neither deform nor jam in the catch 36 when tension is released by impact. While candle jars are not novel, they must be of corresponding dimensions to fit their appropriate sleeve securely enough so that the sleeve does not detach from said jar upon impact. Candle jars can be transparent, translucent or made of colored or textured glass, but should be of a temper that does not readily crack when repeatedly heated by a candle and then inadvertently impacted, a result which defeats the purpose of this device.

As described above, other materials are not ruled out or similar combinations of materials leading to the same result. In one embodiment, the closure halves, sleeves, pivot, trigger pin, and (in some embodiments) impact legs are made from a plastic polymer.

Figure 10:
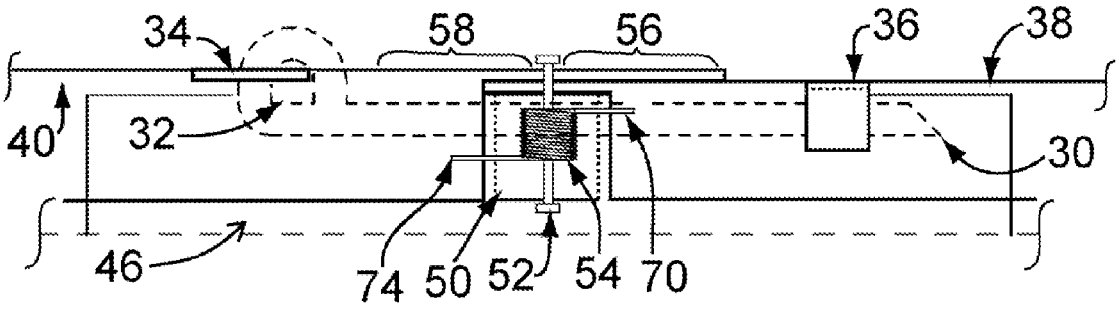
FIG. 10 shows a rear close up view of a closure and bracket assembly.
Figure 12A:
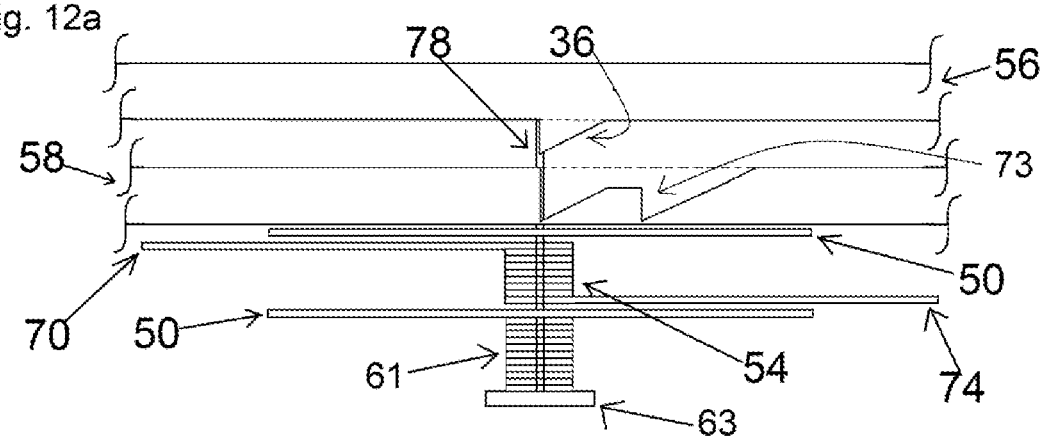
FIG. 12A shows a rear closeup view of a closure bracket and left and right tang with the catch and catch receiver holder with springs.

An additional embodiment of the closure system 10 may be molded of a high grade plastic polymer. Such a closure system 10 lacks the trigger pin 30, loop 34, and legs 22, and has the catch 36 positioned to the inside edge of the cylindrical closures 38, 40 as shown in FIG. 10. Operation of this embodiment requires the user to open the left and right cylindrical closures 38, 40 until both catches 36 click over the edge of cylindrical sleeve top edge 46. As shown in FIG. 12A, the catch 36 and catch receiver holder 73 have been moved to the area of the right and left tang 56, 58 between the pivot pole 78 and the edge of the left and right tang 56, 58. The catch may be configured as shown in FIG. 12A or in the form of a ball and hole. The closure system 10 operates in a similar manner as described for the above embodiments, with the exception that the user is not required to set a trigger pin 30. Rather, the left and right cylindrical closures 38, 40 are opened until both catches 36 click over the edge of cylindrical sleeve top edge 46. Upon being bumped or hit, the closure system 10 snaps shut.

FIG. 10 shows a closeup view of the rear of a cylindrical sleeve 46, cylindrical closures 38, 40, and closure bracket 50 assembly. Central to the device, the pivot 52 runs through a spring 54 which employs its left spring arm 70 over the left rim of 38 and its right spring arm 74 over the right rim of 40. The spring 54 and pivot 52 are secured to the cylindrical sleeve 46 by means of the closure bracket 50.

Figure 11A:
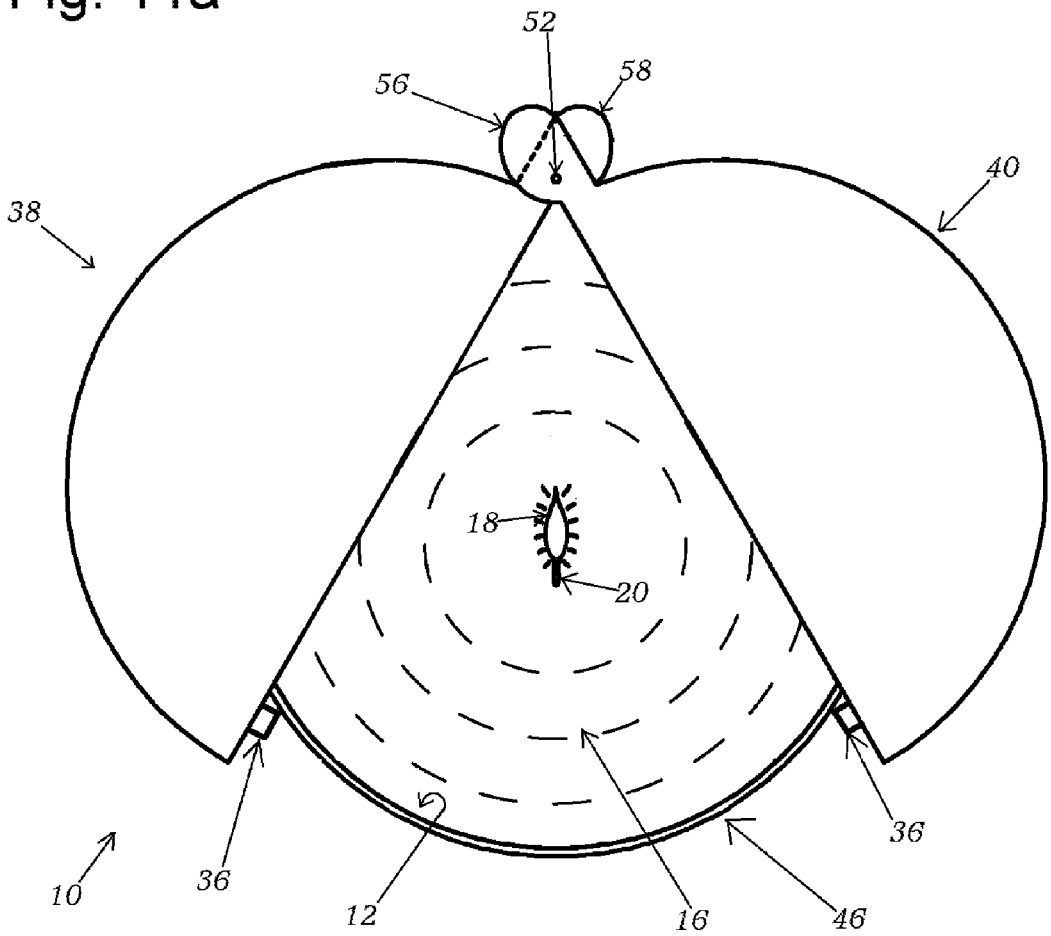
FIG. 11A shows a top view of a cylindrical holder version of the invention with its both catches holding open its closure halves.

FIG. 11A shows a top view of a cylindrical holder 12 version of the closure system 10 with the pair of catches 36 holding open its closure halves 38, 40. The left cylindrical closure 38 includes a protruding left tang 58, while the right cylindrical closure 40 has a similar right tang 56, and both are hinged together by means of a pivot (pin) 52. The candle 16 with its flame 18 and wick 20, are housed in the cylindrical holder 12, on which is secured a cylindrical sleeve 46 onto which the above closure elements are housed.

Figure 11B:
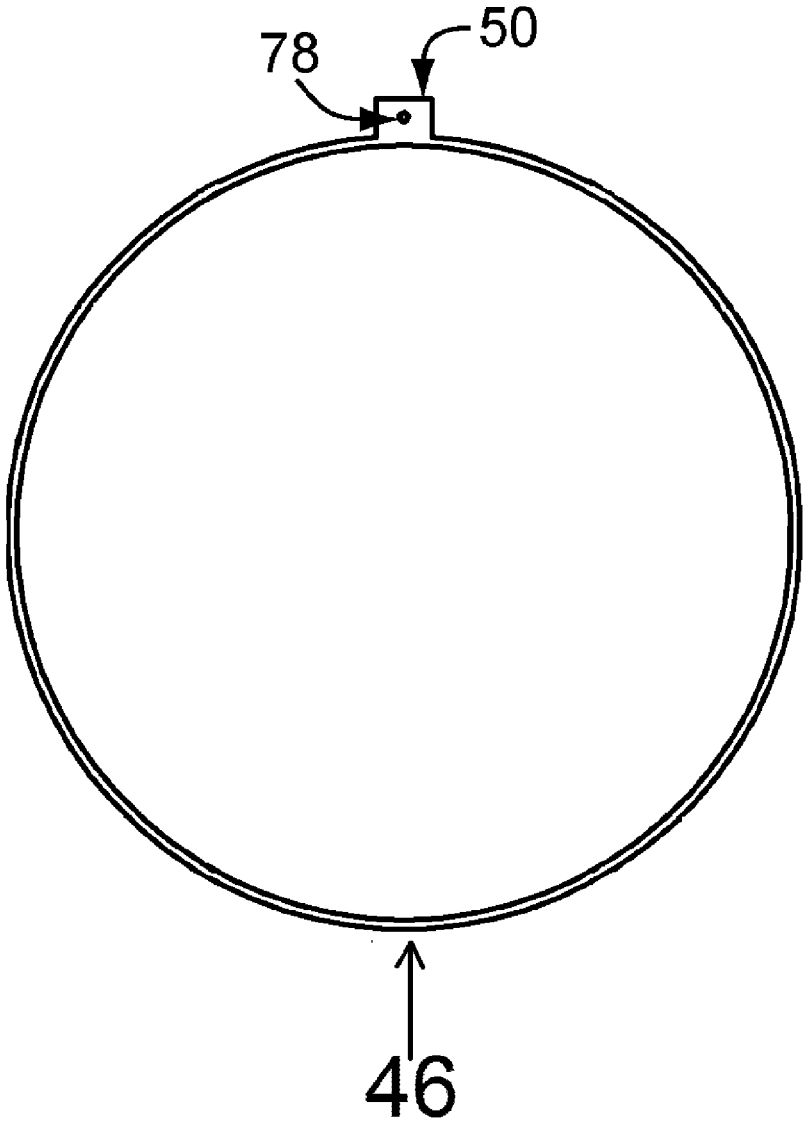
FIG. 11B shows a top view of a cylindrical holder sleeve assembly.

FIG. 11B shows a top view of a cylindrical sleeve 46 assembly which also exposes the top of the closure bracket 50 with its pivot hole 78 through which the pivot 52 rotates.

Figure 11C:
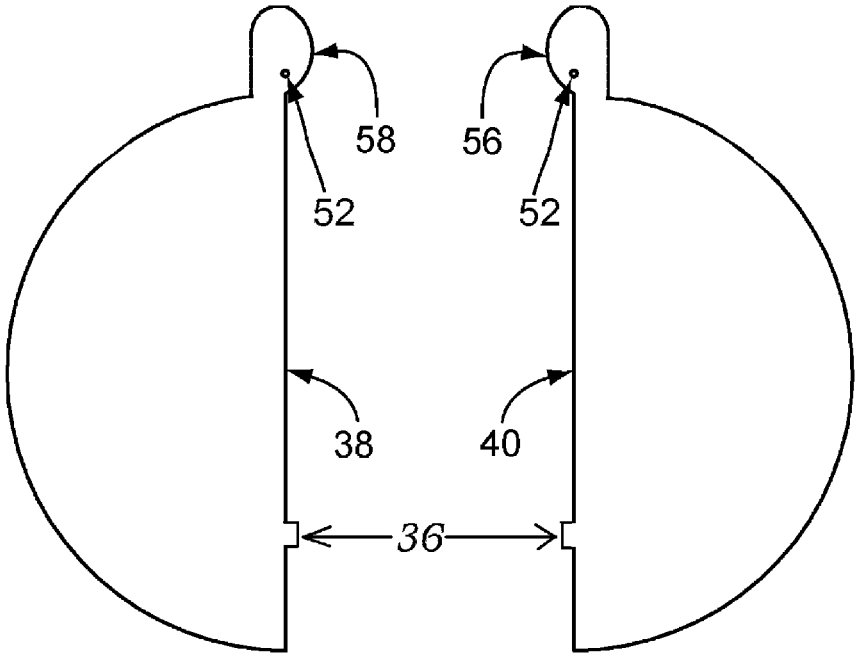
FIG. 11C shows a plan view of the closure halves for a cylindrical holder.

FIG. 11C shows a plan view of the closure halves for a cylindrical holder 12, namely the left cylindrical closure 38 and right cylindrical closure 40. Both are hinged together by means of a pivot (pin) 52. When opened, the pair of catches 36 click to hold the closure system 10 in the open position.

FIG. 12A shows a closeup view of the rear of a cylindrical sleeve 46, cylindrical closures 38, 40, and closure bracket 50 assembly. Central to the device, the pivot 52 runs through a spring 54 which employs its left spring arm 70 over the left rim of 38 and its right spring arm 74 over the right rim of 40. The spring 54 and pivot 52 are secured to the cylindrical sleeve 46 by means of the closure bracket 50. The catch 36, catch receiver holder 73, compression spring 61, and clamp 63 for the compression spring 61 are also shown.

Figure 12B:
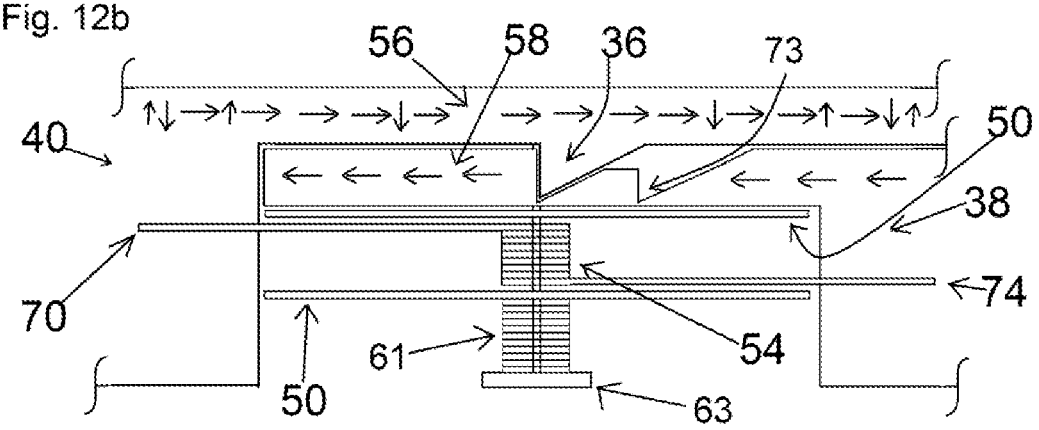
FIG. 12B shows a rear closeup view of a closure bracket and left and right tang with the catch and catch receiver holder with springs in a closed position.

FIG. 12B (closed position) shows a closeup view of the rear of a cylindrical sleeve 46, cylindrical closures 38, 40, and closure bracket 50 assembly. Central to the device, the pivot 52 runs through a spring 54 which employs its left spring arm 70 over the left rim of 38 and its right spring arm 74 over the right rim of 40. The spring 54 and pivot 52 are secured to the cylindrical sleeve 46 by means of the closure bracket 50. The catch 36, catch receiver holder 73, compression spring 61, and clamp 63 for the compression spring 61 are also present. The closed position is shown. The arrows indicate the direction in which both cylindrical closures 38, 40 move to open.

Figure 12C:
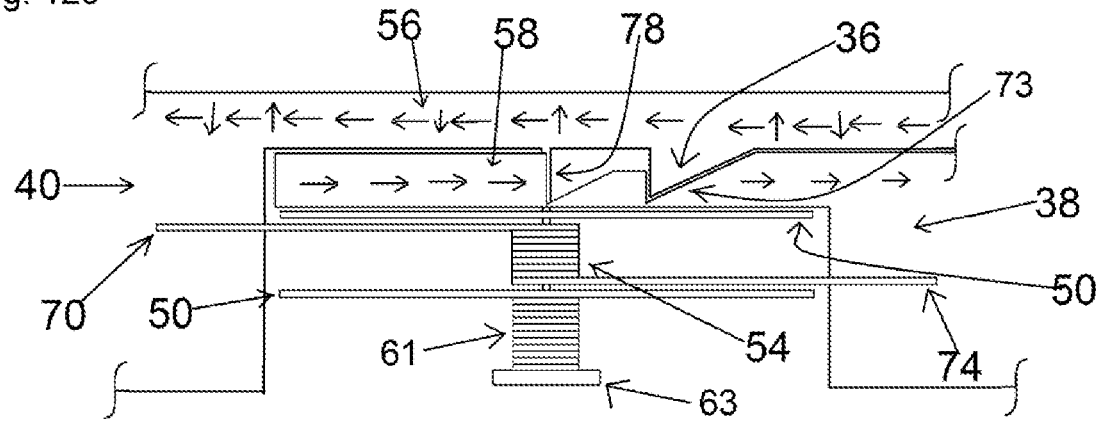
FIG. 12C shows a rear closeup view of a closure bracket and left and right tang with the catch and catch receiver holder with springs in a open position.

FIG. 12C (open position) shows a closeup view of the rear of a cylindrical sleeve 46, cylindrical closures 38, 40, and closure bracket 50 assembly. Central to the device, the pivot 52 runs through a spring 54 which employs its left spring arm 70 over the left rim of 38 and its right spring arm 74 over the right rim of 40. The spring 54 and pivot 52 are secured to the cylindrical sleeve 46 by means of the closure bracket 50. The catch 36, catch receiver holder 73, compression spring 61, and clamp 63 for the compression spring 61 are also present. The open position is shown. The arrows indicate the direction in which both cylindrical closures 38, 40 move to close.

In one embodiment, the design can be used in a toy or game where wrestling dolls use a ring with gadgets attached to the dolls. The toy would also be in a package, with a barrel with to trap the other wrestling doll in it by throwing the doll in it and snapping the barrel shut. The toy has four arms going through the side of the barrel to strike at a target by hitting them with punching gloves that spring back out of the side for the next blow to the target. The toy uses the same design but would be made from plastic and the arms at the top are replaced with arms through the side of a see through cage barrel. The release pin has a flat arm to the bottom of the cage so when the toy lands on a plate in the bottom of the cage, the toy releases the pin.

Figure 8:
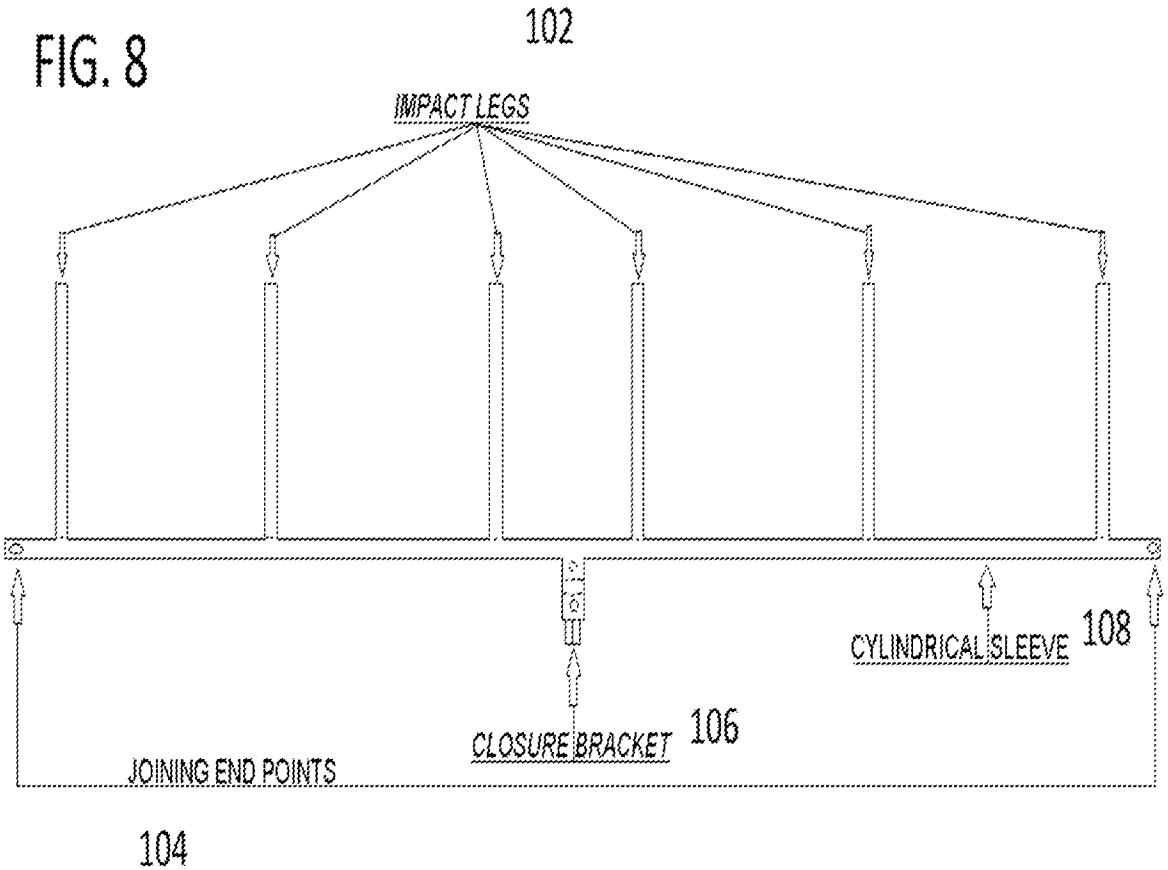
FIG. 8 shows an exemplary view of the impact legs mounted on a cylindrical sleeve.
Figure 9A:
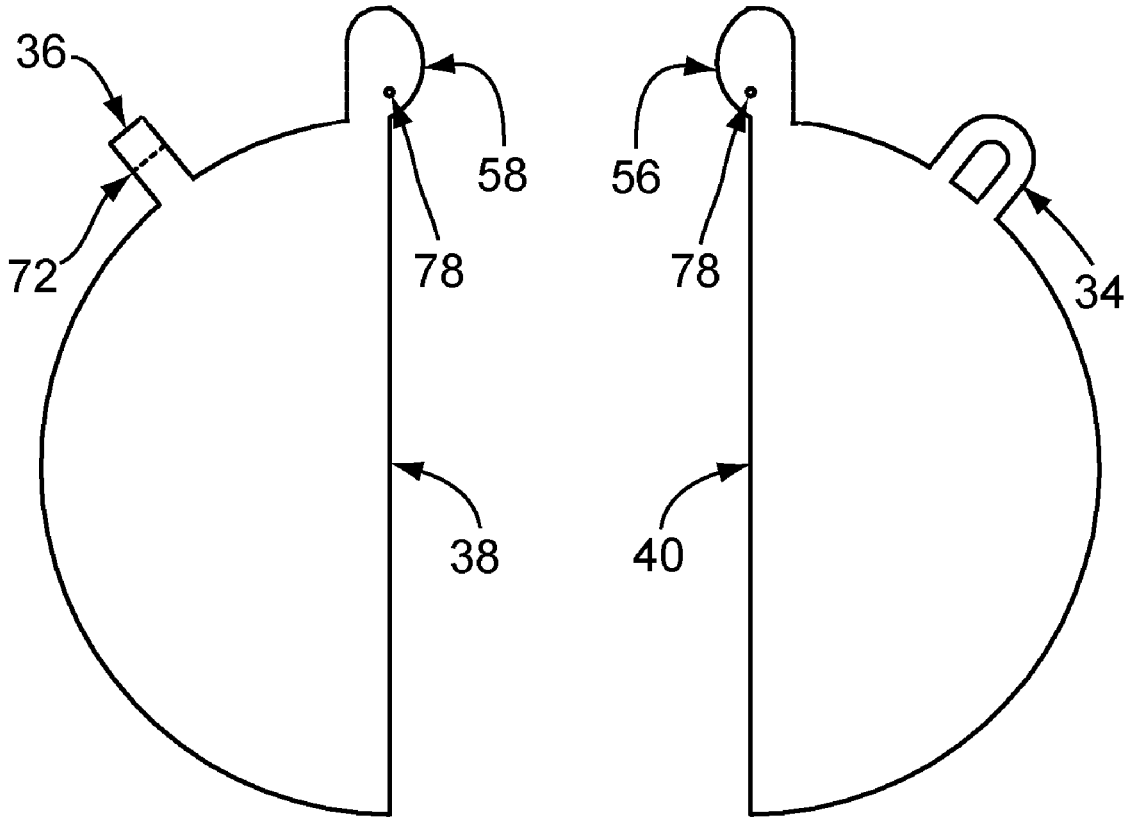
FIG. 9A shows a plan view of the closure halves for a third cylindrical holder embodiment.
Figure 9B:
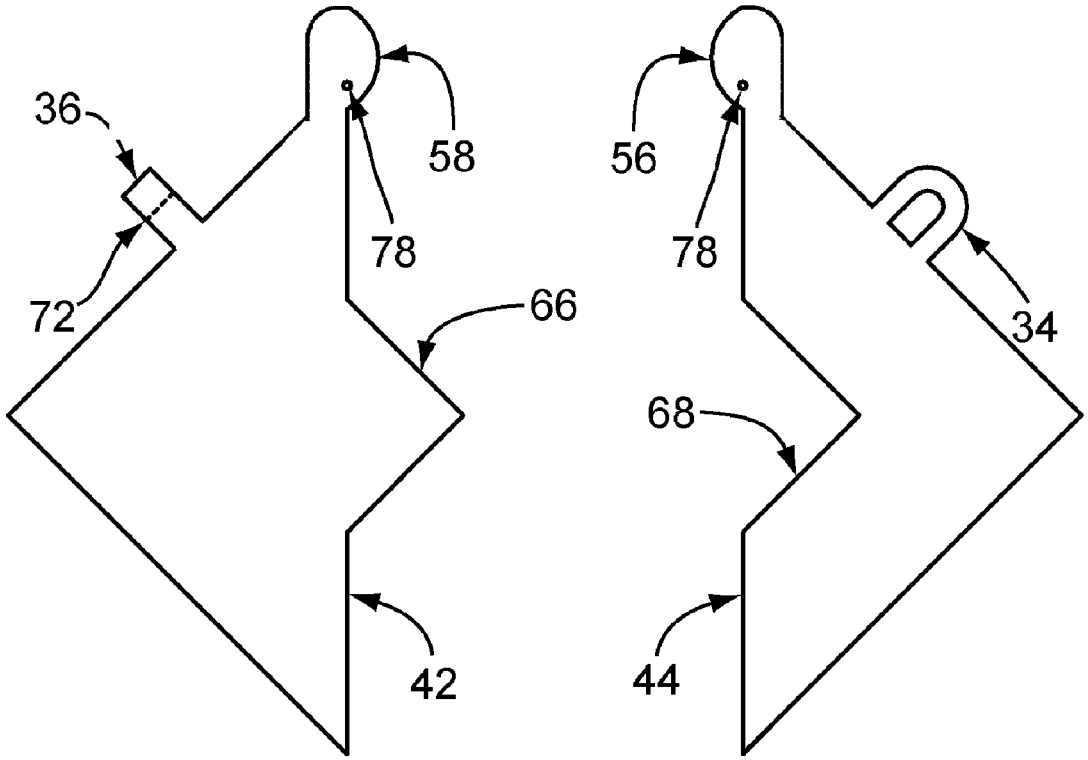
FIG. 9B shows a plan view of the closure halves for a third rectangular holder embodiment.

FIG. 8 shows an exemplary view of impact legs 102 mounted on a cylindrical sleeve 108. The sleeve 108 has joining end points 104. A closure bracket 106 is centrally positioned on the cylindrical sleeve 108. The sleeve may be secured by a close tolerance fit, threading, heat tolerant adhesives, or by means of adjustably fastening overlapping ends of the sleeve. This is effected by providing a number of holes for fasteners near each end of the sleeve, and at least half of these holes permit the fastening be adjusted so that the sleeve may be secured adequately so as to prevent the closure system from detaching when impacted or tipped.

PART NUMBERS

| | |
|---|---|
| 10 | Fire Safety Closure System for Candle Holders |
| 12 | Cylindrical Holder |
| 14 | Rectangular Holder |
| 16 | Candle |
| 18 | Flame |
| 20 | Wick |
| 22 | Impact Leg |
| 24 | Threaded Hole |
| 26 | Threading |
| 28 | Weld |
| 30 | Trigger Pin |
| 32 | Eye |
| 34 | Loop |
| 36 | Catch |
| 38 | Left Cylindrical Closure |
| 40 | Right Cylindrical Closure |
| 42 | Left Rectangular Closure |
| 44 | Right Rectangular Closure |
| 46 | Cylindrical Sleeve |
| 48 | Rectangular Sleeve |
| 50 | Closure Bracket |
| 52 | Pivot |
| 54 | Spring |
| 56 | Right Tang |
| 58 | Left Tang |
| 60 | Left Rudder |
| 61 | Compression Spring |
| 62 | Right Rudder |
| 63 | Clamp |
| 64 | Slot |
| 66 | Guide |
| 68 | Notch |
| 70 | Left Spring Arm |
| 72 | Fold Line |
| 73 | Catch Receiver Holder |
| 74 | Right Spring Arm |
| 76 | Tab(s) |
| 78 | Pivot Hole |
| 80 | Magnet |

The foregoing description of the preferred apparatus and method of operation should be considered as illustrative only, and not limiting. Other forming techniques and other materials may be employed towards similar ends. Various changes and modifications will occur to those skilled in the art, without departing from the true scope of the invention as defined in the present disclosure.

What is claimed is:

1. A fire safety system to prevent fire from a candle, comprising:

first closure half with a first catch extending therefrom;

second closure half with a second catch extending therefrom;

a catch receiver holder for engaging each of the first and second catches;

a candle fire trap adapted to receive the candle;

a pivot pin running through pivot holes in the closure halves; and a sleeve housing attached to the closure halves, wherein the first and second closure halves are biased with a spring securing a first catch and a second catch to edges of the first and second closure halves wherein each of the first and second catches are engaged in a catch receiver holder; wherein the first and second catches are disengaged from the catch receiver holder when the candle holder is tipped onto a side or the candle holder is struck with a predetermined force; and the pivot pin is inserted through pivot holes in the closure halves and closing the first and second closures.

2. The system of claim 1, wherein each of the first and second closure halves comprises a protruding tang.

3. The system of claim 2, wherein the tangs are squeezed together to open the closure halves, wherein the catch receiver holder is adapted to receive each of the first and second catches and wherein the tangs are released to apply a tension to a spring pressing on the first and second closure halves.

4. The system of claim 1, wherein the sleeve comprises a cylindrical sleeve, a square sleeve, or a rectangular sleeve.

5. The system of claim 1, comprising an automatic closure means when the container is either struck or overbalanced.

6. The system of claim 1, wherein the pivot pin is non-removably secured to a closure bracket, comprising a spring oriented to cause each spring arm to exert a force so that when the first and second catches disengage from the catch receiver holder, a tension in the spring causes the closure halves to snap shut.

7. The system of claim 6, wherein the first and second catches are released from a tensioned position from within the catch receiving holder to close the first and second closure halves when the candle holder is tipped onto a side or the candle holder is struck with a predetermined force.

8. The system of claim 1, wherein each of the first and second catches extend beyond an edge of one closure half.

9. The system of claim 1, wherein one or more components are formed of a plastic polymer.

10. A method to prevent a fire from a candle housed in first closure half with a first catch extending therefrom; second closure half with a second catch extending therefrom; a catch receiver holder for engaging each of the first and second catches; a candle fire trap adapted to receive the candle; a pivot pin running through pivot holes in the closure halves; and a sleeve housing attached to the closure halves; the method comprising:

biasing the first and second closure halves with a spring securing a first catch and a second catch to edges of the first and second closure halves wherein each of the first and second catches are engaged in a catch receiver holder;

disengaging the first and second catches from the catch receiver holder when the candle holder is tipped onto a side or the candle holder is struck with a predetermined force;

running a pivot pin through pivot holes in the closure halves; and closing the first and second closures.

11. The method of claim 10, comprising urging the two closure halves together with one or more springs when the candle holder is impacted with a predetermined force.

12. The method of claim 10, comprising automatically closing the halves when the container is either struck or overbalanced.

13. A fire safety system to prevent fire from a candle, comprising:

first and second closure halves;

a candle holder inside the first and second closure halves and adapted to receive the candle;

a sleeve housing the closure halves;

a pivot pin running through pivot holes in the closure halves; and a trip device to close the first and second closure halves when the candle holder is tipped or the candle holder is struck with a predetermined force, wherein the first and second closure halves are biased with a spring securing a first catch and a second catch to edges of the first and second closure halves wherein each of the first and second catches are engaged in a catch receiver holder; wherein the first and second catches are disengaged from the catch receiver holder when the candle holder is tipped onto a side or the candle holder is struck with a predetermined force; and the pivot pin is inserted through pivot holes in the closure halves and closing the first and second closures.

* * * * *